US008698021B2

(12) United States Patent
Chu

(10) Patent No.: US 8,698,021 B2
(45) Date of Patent: Apr. 15, 2014

(54) SOCKET STRUCTURE OF MICRO SWITCH

(76) Inventor: Ching-Hsiung Chu, New Taipei (TW)

( * ) Notice: Subject to any disclaimer, the term of this patent is extended or adjusted under 35 U.S.C. 154(b) by 230 days.

(21) Appl. No.: 13/270,241

(22) Filed: Oct. 11, 2011

(65) Prior Publication Data

US 2013/0087439 A1 Apr. 11, 2013

(51) Int. Cl.
*H01H 9/02* (2006.01)

(52) U.S. Cl.
USPC ..... 200/294; 200/345

(58) Field of Classification Search
CPC ..... H10H 9/02; H10H 9/0264
See application file for complete search history.

(56) References Cited

U.S. PATENT DOCUMENTS 4,532,393 A * 7/1985 Koizumi et al. ..... 200/343
4,968,860 A * 11/1990 Shinohara et al. ..... 200/314
6,965,085 B1 * 11/2005 Orrico et al. ..... 200/314
8,287,298 B2 * 10/2012 Hsu et al. ..... 439/352
2004/0118669 A1 * 6/2004 Mou ..... 200/310

* cited by examiner

*Primary Examiner* — Renee Luebke
*Assistant Examiner* — Ahmed Saeed

(57) ABSTRACT

A socket structure of a micro switch includes a plurality conductive pins of at the bottom of the switch, and a plurality of grooves and distal slots, and the grooves are formed at the bottom of the switch, and the pins are disposed in the grooves, and the distal slots are formed on an outer wall of the switch and interconnected to the grooves respectively, and the top of the pin is extended into the distal slot, so that the pin is exposed from the outer wall of the switch, and the grooves are provided for positioning the pins and preventing them from being deformed, and containing a solder paste for soldering to prevent the switch from being protruded, and the distal slots are provided for extending a soldering iron to touch that pins to facilitate removing and soldering the switch on a surface of a circuit board.

22 Claims, 10 Drawing Sheets

(B-B)

SOCKET STRUCTURE OF MICRO SWITCH

BACKGROUND OF THE INVENTION

1. Field of the Invention

The present invention relates to a socket structure of a micro switch, in particular to the socket structure having grooves and distal slots to facilitate positioning, protecting and using a soldering iron for manufacturing conductive pins repeatedly.

2. Description of the Prior Art

In general, a traditional micro switch comprises a plastic base, a moving shaft and an electrode set. The base is mounted on another plastic retaining base, and the moving shaft has a press button installed thereon, and the micro switch is operated by pressing the press button to drive the moving shaft, such that positive and negative electrodes of the electrode set in the base can be electrically conducted with each other to achieve the effects of turning on and off a power supply. In addition, the switch generally includes a plurality of conductive pins installed at the bottom of the switch, and the conductive pins include the positive and negative electrodes extended to electrode pins at the bottom of the switch respectively. When the switch is situated at a surface of a circuit board of an electronic device or instrument, the conductive pins are soldered to circuits on the surface of the circuit board by using a solder paste.

However, the pins are affected by external forces easily before they are soldered onto the circuit board, so that the pins may be crooked and not properly attached onto the metal circuits on the circuit board. In addition, after the switch is processed by a surface mount technology (SMT) process, the solder paste and soldering flux may be accumulated between the bottom of the switch and the surface of the circuit board, such that the switch is protruded to affect the availability rate of assembling the micro switch onto the circuit board.

In addition, most circuit boards have positioning holes on the surface of the circuit boards for inserting, soldering and positioning the pins of the switch. Alternatively, no positioning holes are formed on the circuit board, but the pins are soldered onto the surface of the circuit board directly. If it is necessary to remove the switch from the surface of the circuit board for a re-soldering, and the backside of the circuit board is not exposed or no positioning hole for the circuits is available, the gap between the bottom of the switch bottom and the surface of the circuit board is not sufficient for extending a soldering iron into the internal side of the bottom of the switch to touch the pins. As a result, it is difficult to perform the re-soldering process for the switch on the surface of the circuit board.

SUMMARY OF THE INVENTION

Therefore, it is a primary objective of the present invention to overcome the drawbacks of the prior art by providing a socket structure that can facilitate positioning, protecting and using a soldering iron for manufacturing conductive pins repeatedly, and solve the problems of having crooked pins due to external forces before the soldering takes place, and a protruded switch due to the solder pastes accumulated between the micro switch and the circuit board, and the difficulty of soldering the pins onto the surface of circuits on the circuit board directly. Therefore, the present invention can improve the availability rate of assembling the micro switch onto the circuit board and overcome the issue of removing and re-soldering the switch onto the surface of the circuit board.

To achieve the aforementioned objective, the present invention provides a socket structure of a micro switch, and the switch includes a plurality of conductive pins at the bottom of the switch, and the socket structure comprises:

a plurality of grooves, formed at the bottom of the switch, and the pins being disposed in the grooves respectively; and a plurality of distal slots, formed on an outer wall of the switch and interconnected to the grooves respectively, so that the pins are exposed from the outer wall of the switch.

The grooves are provided for positioning the pins and preventing them from being deformed, and containing a solder paste for the soldering to prevent the switch from being protruded. The distal slots are provided for extending a soldering iron to touch the pins, so as to facilitate the process of removing and re-soldering the switch onto a surface of the circuit board.

In addition, the present invention further provides another socket structure of a micro switch, and the switch has a plurality of conductive pins at the bottom of the switch, and the socket structure comprises:

a plurality of grooves, formed at the bottom of the switch, and the pin being installed in the groove; and a plurality of distal slots, formed on the outer wall of the switch, and the top of the pins being extended into the distal slots respectively and exposed from the outer wall of the switch.

The grooves are provided for positioning the pins, preventing them from being deformed, and containing a solder paste to prevent the switch from being protruded, and the distal slots are provided for extending a soldering iron to touch the pins, so as to facilitate removing and re-soldering the switch onto the surface of the circuit board.

Wherein, the pins include at least two electrode pins and two power supply pins of at least one light emitting diode.

In addition, the switch further comprises:

a retaining base, having at least one positioning pillar disposed at the bottom of the retaining base;

a base, disposed at a distal side of the retaining base, and having a containing slot formed on a side of the base, and a notch formed at an outer edge of the containing slot and having a height different from those of two first end surfaces and a second end surface, and the distance from a groove bottom of the containing slot to the first end surface being greater than the distance from the groove bottom to the second end surface;

the bottom of the switch bottom being the bottom of the retaining base and the base, and the outer wall of the switch being an exposed wall of the retaining base and the base;

an electrode set, installed in the containing slot, and having electrode pins extended to the bottom of the base;

an axle sleeve, slidably installed in the containing slot, and guided by an inner wall of the containing slot to selectively approach and separate the electrode set, and the axle sleeve having a pair of cylindrical grooves formed thereon and opened to the outside;

a conductive bracket, installed in the containing slot between the axle sleeve and the electrode set, and driven by the axle sleeve to attach and separate the electrode set for connecting and disconnecting the electrode set respectively;

a metal frame element, sheathed on an external periphery of the axle sleeve and blocked and positioned by the second end surface, and the frame element having at least one positioning pin extended to the bottom of the base and situated adjacent to the distal slot; and a light emitting diode, installed in the cylindrical groove, and having a power supply pin extended to the bottom of the base, and blocked and positioned by the first end surface to define a specific distance between the frame element and the power supply pin.

The present invention is illustrated by the embodiment as follows:

The retaining base includes a plurality of mouldings formed on a side of the retaining base, and the base is disposed between the mouldings.

The first end surfaces are formed on the base and protruded from both sides of a notch of the containing slot respectively.

A guide slot is formed on both upper and lower sides of the axle sleeve separately and interconnected to the cylindrical groove, and the power supply pin is extended through the guide slot to the switch bottom.

The frame element has an opening sheathed on the external periphery of the axle sleeve.

The frame element has an ear plate formed at both sides of the frame element separately, and the retaining base has a latch portion formed on both sides of the retaining base separately, and the ear plate has a latch slot formed thereon and latched to the latch portion.

The second end surface has a plurality of bumps formed around the periphery of the base and at positions corresponding to the contour of the periphery of the frame element, and the frame element is contained and positioned between the bumps.

The first end surface has two symmetrical ear plates formed at positions adjacent to the base and corresponding to the contour of the periphery of the power supply pin, and the power supply pin is contained and positioned between the ear plates.

A transparent press button made of a soft heat resisting material is installed at a position on the axle sleeve and exposed from the containing slot and covers the cylindrical groove, and the soft heat resisting material can be silicon.

A high temperature patch with a flat surface is attached onto the top of the switch to facilitate accessing the switch during a SMT process and prevent a material drop situation.

Compared with the prior art, the present invention provides the grooves for positioning and protecting the conductive pins, and preventing the pins from being crooked and deformed by external forces, and uses the groove for containing the solder paste and soldering flux accumulated between the switch and the circuit board to prevent the switch from being protruded. The distal slots are provided for extending a soldering iron to touch the pins, so as to facilitate removing and re-soldering the switch onto the surface of the circuit board. The present invention can improve the availability rate of assembling the micro switch onto the circuit board and overcome the problems of having difficulty to remove and re-solder the switch onto the surface of the circuit board.

DETAILED DESCRIPTION OF THE PREFERRED EMBODIMENTS

Figure 1:
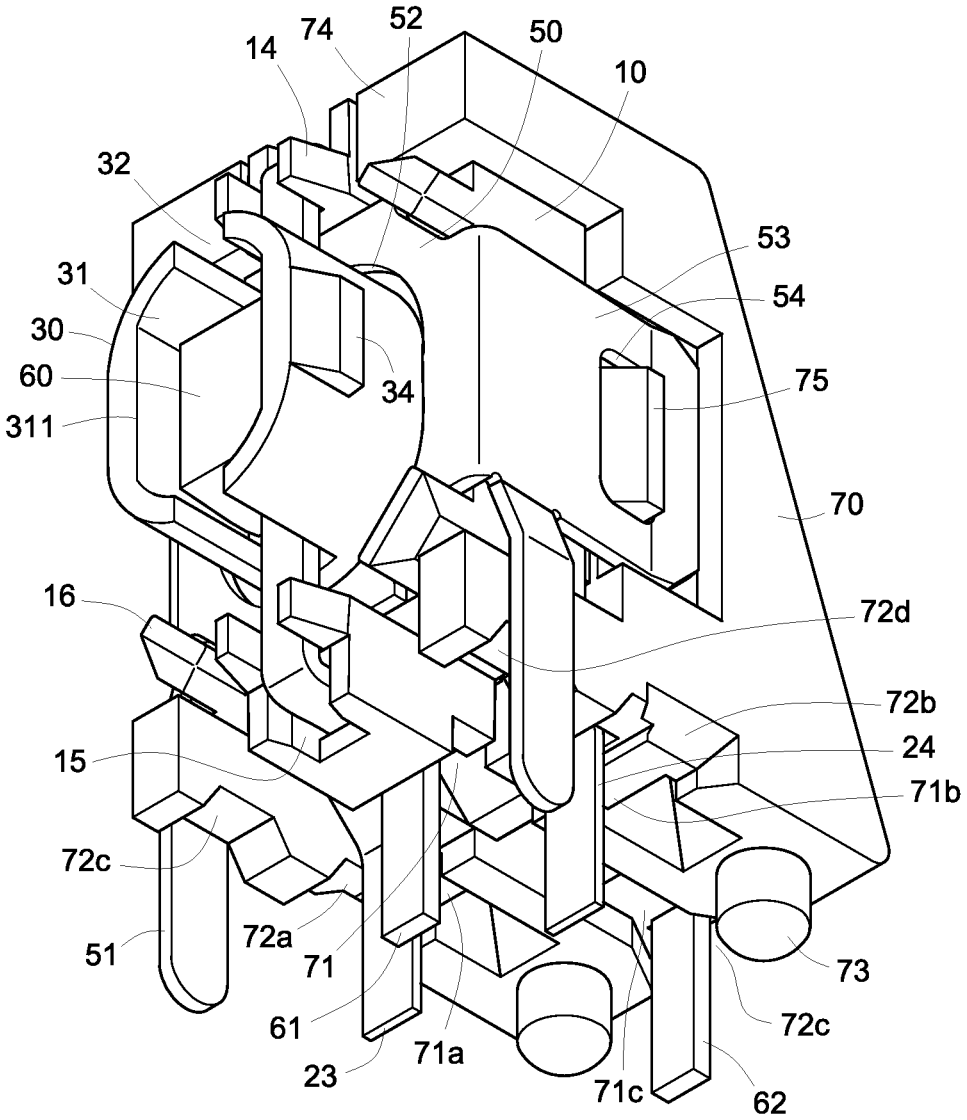
FIG. 1 is a perspective view of a preferred embodiment of the present invention.
Figure 2:
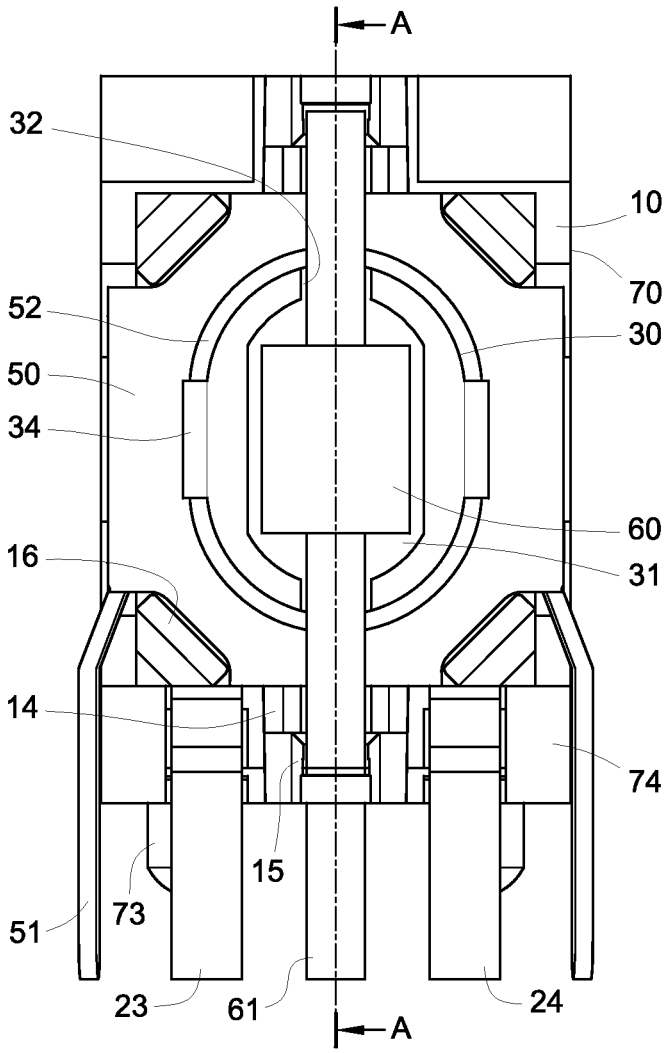
FIG. 2 is a front view of FIG. 1.
Figure 3:
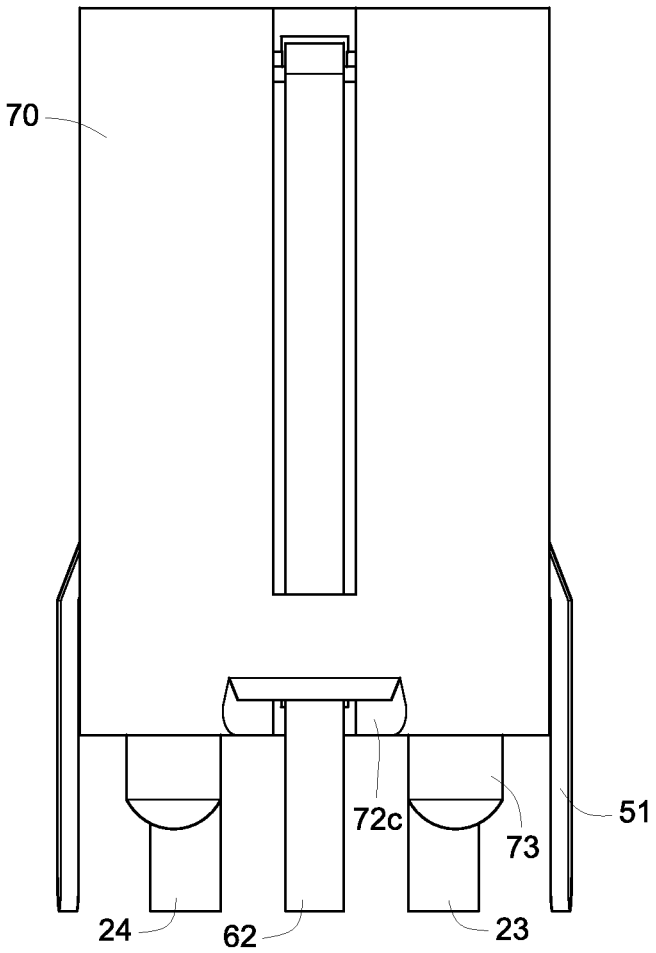
FIG. 3 is a rear view of FIG. 2.
Figure 4:
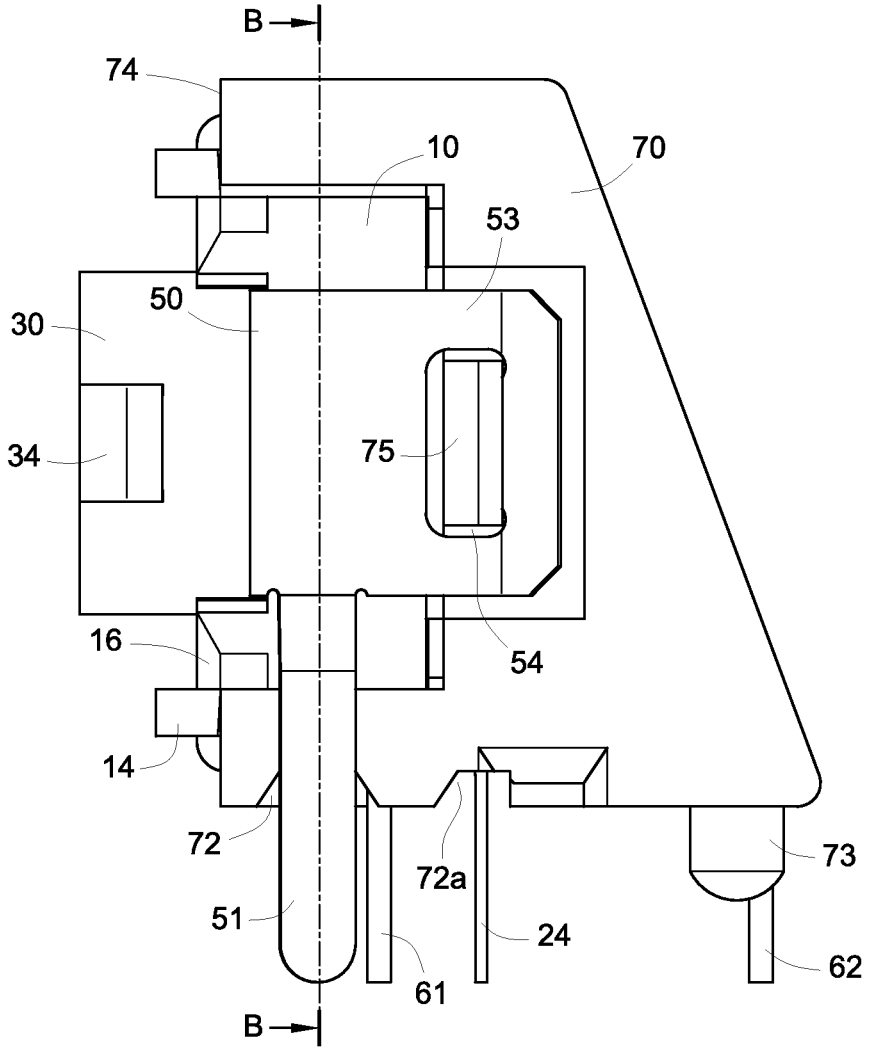
FIG. 4 is a right-side view of FIG. 2.
Figure 5:
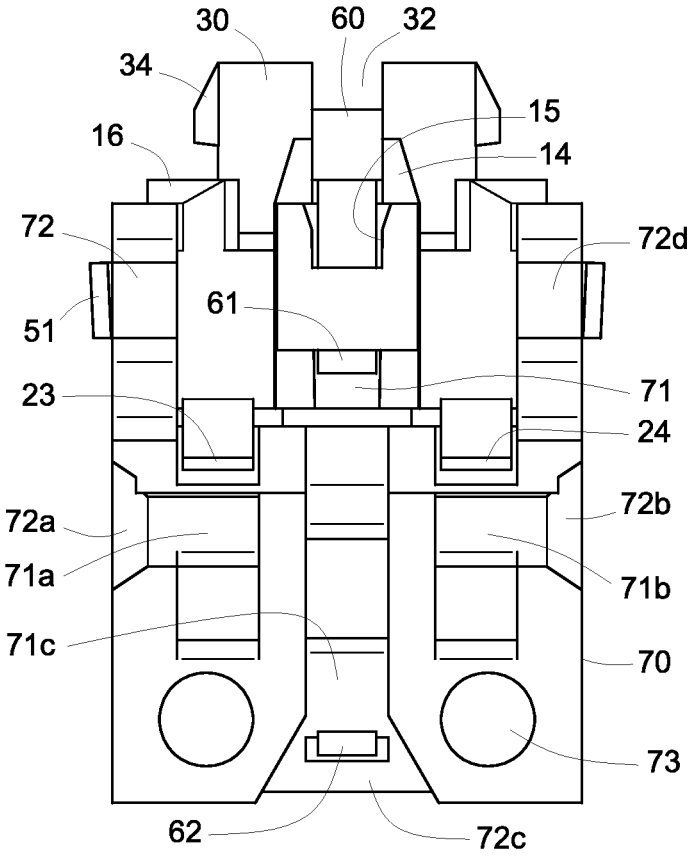
FIG. 5 is a bottom view of FIG. 2.

With reference to FIG. 1 for a perspective view of a socket structure of a micro switch in accordance with a preferred embodiment of the present invention, together with FIGS. 2 to 5, the socket structure of the present invention has a plurality of conductive pins at the bottom of the switch bottom, and the conductive pins include at least two electrode pins 23, 24 and two power supply pins 61, 62 of at least one light emitting diode 60, and the electrode pins 23, 24 are positive electrode pin 23 and negative electrode pin 24 of the switch, and the power supply pins 61, 62 are positive power supply pin 61 and negative power supply pin 62 of the light emitting diode 60.

The socket structure comprises a plurality of grooves 71, 71*a*, 71*b*, 71*c* and a plurality of distal slots 15, 72, 72*a*, 72*b*, 72*c*, 72*d* (as shown in FIGS. 6 to 10). The grooves 71, 71*a*, 71*b*, 71*c* are formed at the bottom of the switch, wherein the positive power supply pin 61 is disposed in the groove 71, the negative power supply pin 62 is disposed in the groove 71*c*, the positive electrode pin 23 is disposed in the groove 71*a*, and the negative electrode pin 24 is disposed in the groove 71*b*.

The distal slots 15, 72, 72*a*, 72*b*, 72*c*, 72*d* are formed at the bottom of the outer wall of the switch, and the distal slots 72*a*, 72*b*, 72*c* are interconnected to the grooves 71*a*, 71*b*, 71*c* respectively, so that the positive electrode pin 23, negative electrode pin 24, and negative power supply pin 62 are exposed from exposed from the outer wall of the switch, and the top of the positive power supply pin 61 is extended into the distal slot 15 and exposed from the outer wall of the switch.

The switch comprises a trapezoidal retaining base 70, a rectangular plastic base 10, an electrode set 20, an elliptical axle sleeve 30, a conductive bracket 40, a metal frame element 50 and a light emitting diode 60; wherein the retaining base 70 has at least one plastic positioning pillar 73 formed at the bottom of the retaining base 70 and inserted onto circuit board, and the retaining base 70 has a plurality of mouldings 74 formed on a side of the retaining base 70.

Figure 6:
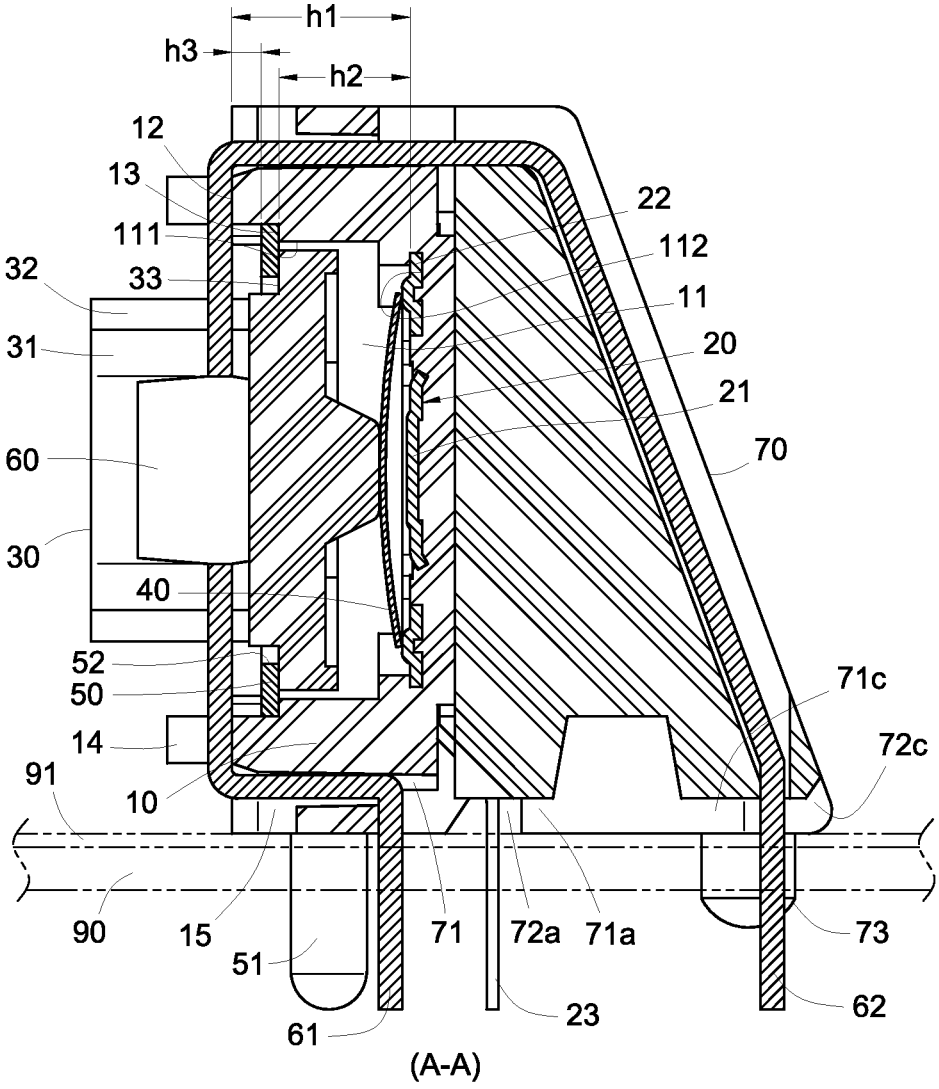
FIG. 6 is a cross-sectional view of Section A-A of FIG. 2.
Figure 10:
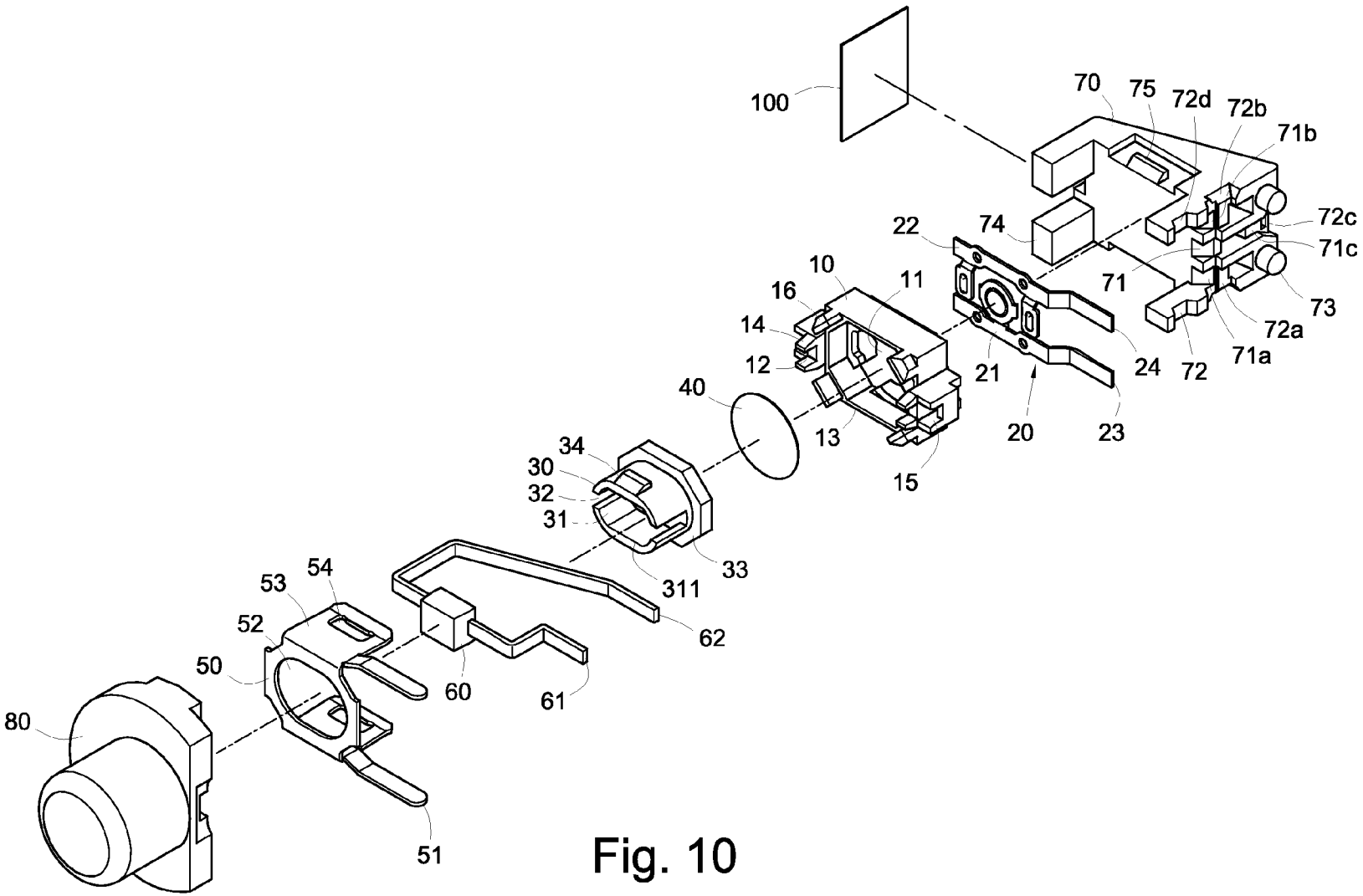
FIG. 10 is an exploded view of FIG. 1.

The base 10 is disposed between the mouldings 74 on a side of the retaining base 70, and a containing slot 11 is formed on a distal side of the base 10 (as shown in FIGS. 6 and 10), and two first end surfaces 12 and a second end surface 13 formed at the external periphery of a notch 111 of the containing slot 11 and having different heights.

The distance h1 from a groove bottom 112 of the containing slot 11 to the first end surface 12 is greater than the distance h2 from the groove bottom 112 to the second end surface 13. A notch 111 of the containing slot 11 is formed and protruded from the external periphery of the first end surface 12 and at both sides of the base 10. The bottom of the switch is the bottom of the retaining base 70 and the base 10, and the outer wall of the switch is a wall exposed from the retaining base 70 and the base 10.

The electrode set 20 is installed in the containing slot 11 and positioned at the groove bottom 112 of the containing slot 11, and the electrode set 20 includes a positive electrode 21 and a negative electrode 22, and the positive and negative electrodes 21, 22 are extended to the positive and negative electrode pins 23, 24 at the bottom of the switch respectively.

An and of the axle sleeve 30 is slidably installed in the containing slot 11 and guided by an inner wall of the containing slot 11 to approach to and separate from the electrode set 20 at the groove bottom 112, and another end of the axle sleeve 30 is exposed from the containing slot 11 to form a cylindrical groove 31 opened to the outside. The portion of the axle sleeve 30 exposed from the containing slot 11 can be pushed by an external force, so that the axle sleeve 30 can move in a direction towards the groove bottom 112.

The conductive bracket 40 is installed in the containing slot 11 between an end of the axle sleeve 30 and the electrode set 20 and capable of elastically driving the axle sleeve 30 to move towards the notch 111 of the containing slot 11, and the conductive bracket 40 can be driven by the axle sleeve 30 to attach and separate the electrode set 20 so as to selectively connect and disconnect the positive and negative electrodes 21, 22 of the electrode set 20.

The metal frame element 50 has an opening 52 for sheathing on the external periphery of the axle sleeve 30, and the frame element 50 is blocked by the second end surface 13 and positioned at the external periphery of the notch 111 of the containing slot 11, and at least one positioning pin 51 is formed at the bottom of the frame element 50. In this preferred embodiment, there are two positioning pins 51 formed at the bottom on both side of the frame element 50 and extended to the bottom of both sides of the base 10, the positioning pins 51 are disposed at positions adjacent to the distal slots 72, 72*d* respectively.

The light emitting diode 60 is fixed in the cylindrical groove 31, and has positive and negative power supply pins 61, 62 extended to the bottom of the switch, and the positive and negative power supply pins 61, 62 at the external periphery of the notch 111 of the containing slot 11 are blocked by the first end surface 12 and positioned at both sides of the axle sleeve 30, so that a specific distance h3 is defined between the frame element 50 and the positive and negative power supply pins 61, 62 for an insulation effect (as shown in FIG. 6) to prevent a short circuit occurred between the frame element 50 and the positive and negative power supply pins 61, 62.

Figure 7:
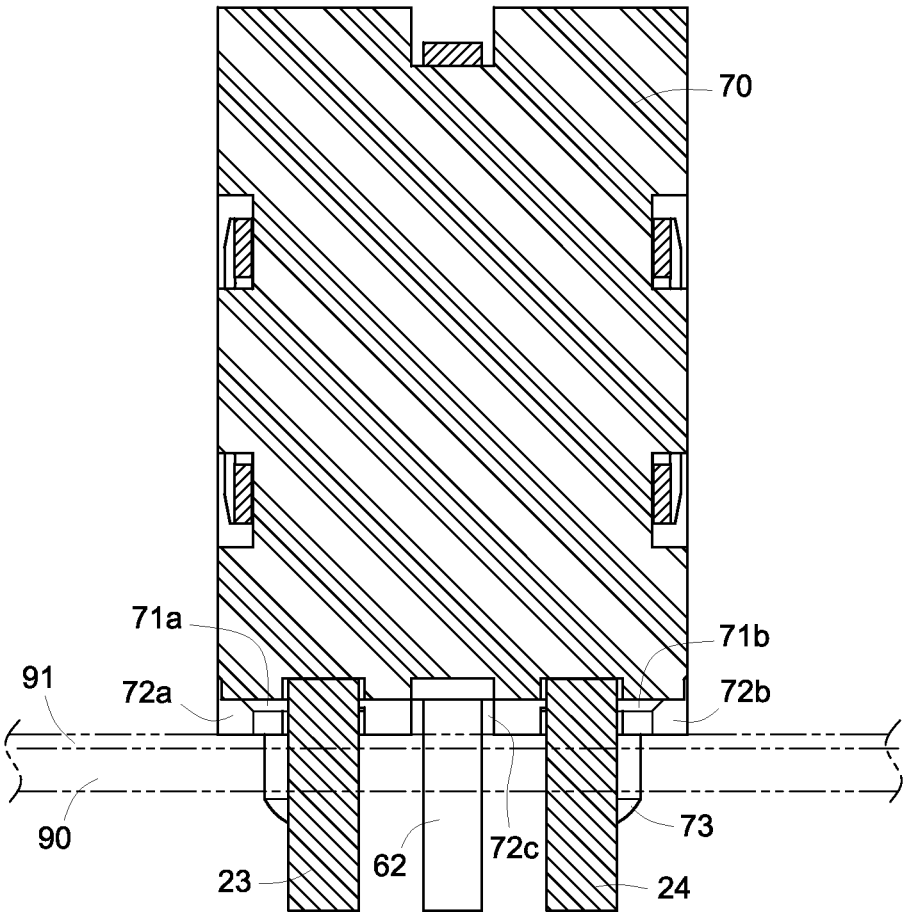
FIG. 7 is a cross-sectional view of Section B-B of FIG. 2.
Figure 8:
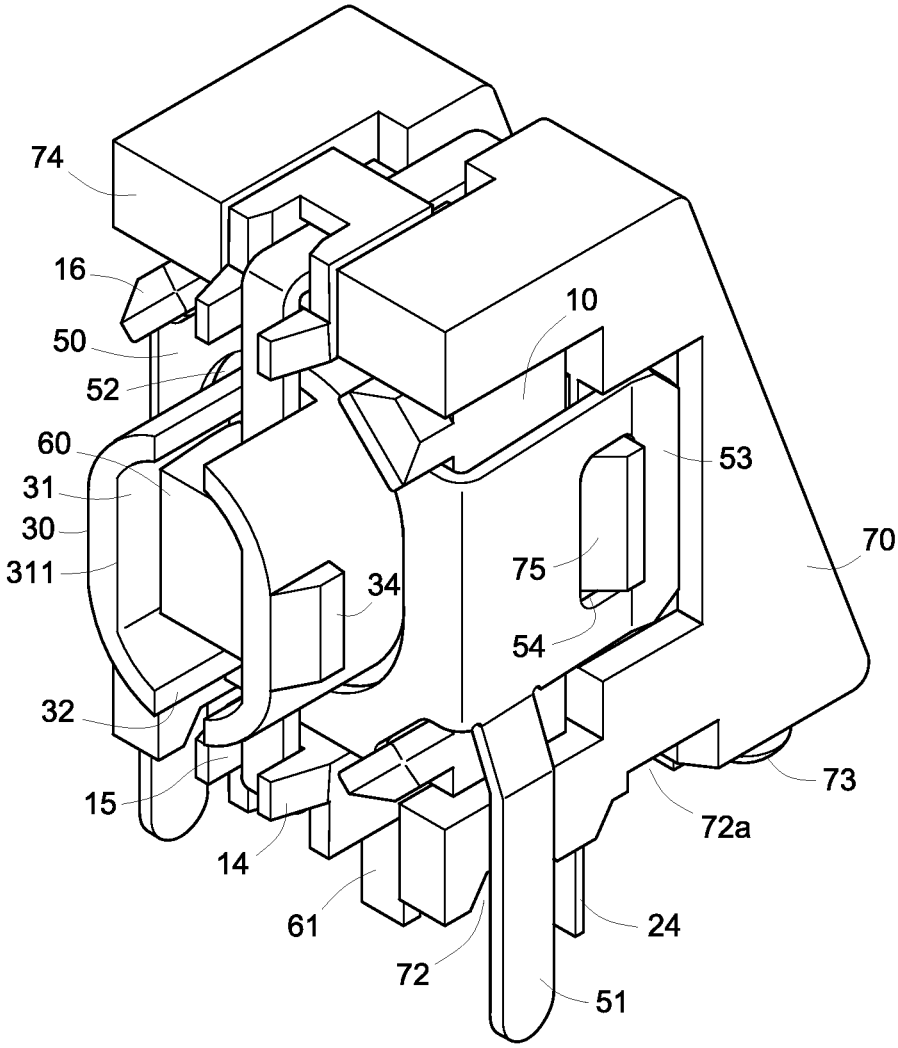
FIG. 8 is a perspective view of FIG. 1 viewed at a different angle.
Figure 9:
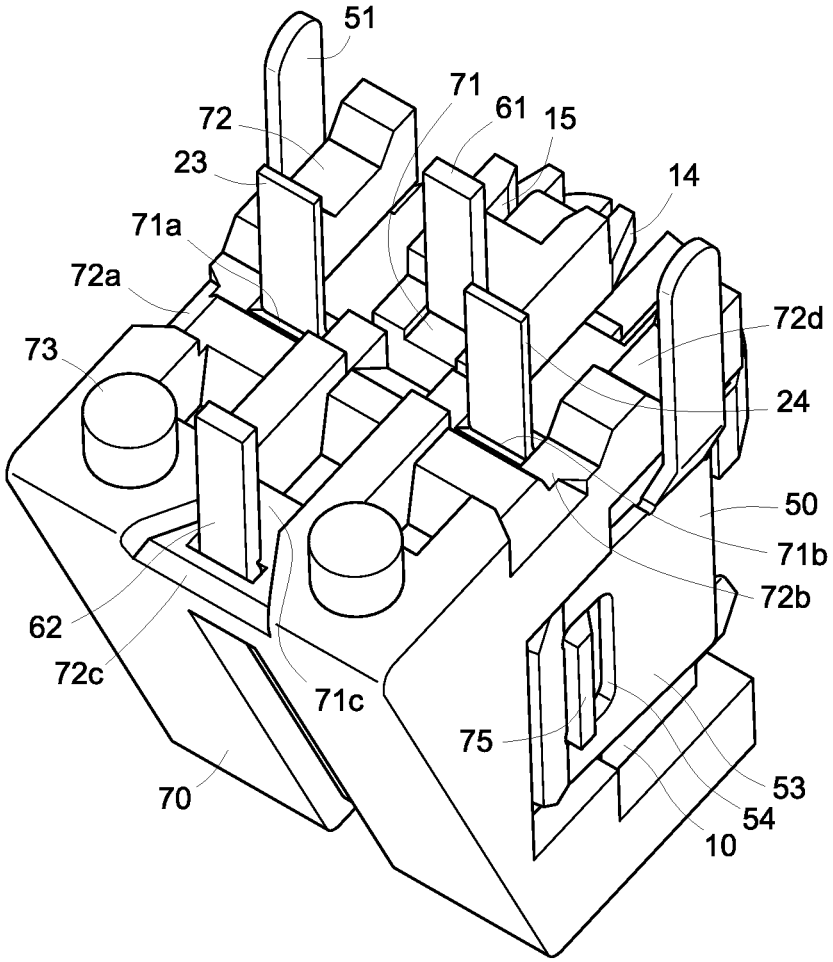
FIG. 9 is a perspective view of FIG. 1 viewed at another different angle.

Therefore, the retaining base 70 and the base 10 of the switch cam be arranged on a surface of a circuit board (as shown in FIGS. 6 and 7), so that the positive and negative power supply pins 61, 62, the positive and negative electrode pins 23, 24 and the positioning pin 51 can be attached to a metal circuit layer 91 on the surface of the circuit board 90.

And then, the circuit board 90 is sent into a solder furnace for carrying out the surface mount technology (SMT) process, and the solder paste in the solder furnace is filled between the positive and negative power supply pins 61, 62, the positive and negative electrode pins 23, 24, and the positioning pin 51 and a surface of the circuit layer 91 for soldering the positive and negative power supply pins 61, 62, the positive and negative electrode pins 23, 24, and the positioning pin 51 onto the surface of the circuit layer 91, and the positioning pin 51 can enhance the stability of soldering the switch onto the circuit layer 91.

It is noteworthy to point out that before the switch is soldered onto the circuit board 90, the grooves 71, 71*a*, 71*b*, 71*c* can be used for positioning the positive and negative power supply pins 61, 62, and the positive and negative electrode pins 23, 24 to prevent the positive and negative power supply pins 61, 62, and the positive and negative electrode pins 23, 24 from being deformed or crooked by external forces. During the process of soldering the switch onto the circuit board 90, the grooves 71, 71*a*, 71*b*, 71*c* and the distal slots 72, 72*d* can be used for containing the solder paste to prevent the switch from being protruded. After the switch is soldered onto the circuit board 90, the distal slots 15, 72*a*, 72*b*, 72*c* can be used for extending a soldering iron to touch and heat the positive and negative power supply pins 61, 62 and the positive and negative electrode pins 23, 24 in order to melt the solder paste between the positive and negative power supply pins 61, 62 and the positive and negative electrode pins 23, 24 and the surface of the circuit layer 91 to facilitate removing and re-soldering the switch onto the surface of the circuit board 90.

In general, when the axle sleeve 30 is driven by an external force to push and touch the conductive bracket 40 to connect the positive and negative electrodes 21, 22, electric power at the positive and negative electrodes 21, 22 can pass through the positive and negative electrode pins 23, 24 to conduct the circuit layer 91 of the circuit board 90. After the external force for driving the axle sleeve 30 disappears, the resilience of the conductive bracket 40 will drive the axle sleeve 30 to resume its original position and disconnect the positive and negative electrodes 21, 22.

Therefore, the present invention can use the light emitting diode as a light source and the grooves to position and protect the conductive pins and prevent the pins from being deformed or crooked by external forces. In the meantime, the grooves can be used for containing the solder paste and the soldering flux accumulated between the switch and the circuit board to prevent the switch from being protruded. The distal slots are provided for extending a soldering iron to touch the pins, so as to facilitate removing and re-soldering the switch onto the surface of the circuit board. The invention can improve the availability rate of assembling the micro switch onto the circuit board and overcome the problems of having difficulties to remove and solder the switch onto the surface of the circuit board.

In addition, the present invention is characterized in that:

The bracket 40 is substantially in a circular arc protruding shape, and the periphery of the bracket 40 is in contact with the negative electrode 22 (as shown in FIG. 6), and the central portion of the bracket 40 is separated from the positive electrode 21. When the axle sleeve 30 is driven by an external force, the central portion of the bracket 40 is in contact with the positive electrode 21, so that the bracket 40 connects the positive and negative electrodes 21, 22, and the central portion of the bracket 40 will resume its original position to disconnect the positive and negative electrodes 21, 22 when the external force for driving the axle sleeve 30 disappears.

A guide slot 32 is formed on upper and lower side of the axle sleeve 30 separately and interconnected to the cylindrical groove 31, and the guide slot 32 is extended to a notch 311 of the cylindrical groove 31, and the positive and negative power supply pins 61, 62 of the light emitting diode 60 are extended along the upper and lower sides of the axle sleeve 30 from the guide slot 32 to the bottom of the switch, so that when the axle sleeve 30 is driven by an external force to move back and forth, the guide slot 32 can be used for dodging the positive and negative power supply pins 61, 62.

An ear plate 53 is formed on both sides of the frame element 50 separately, and a latch portion 75 s formed on both sides of the retaining base 70 separately, and the ear plate 53 includes a latch slot 54 formed thereon for latching the latch portion 75, so as to integrate the retaining base 70 and the base 10 as a whole.

The axle sleeve 30 has a circular trapezoidal surface 33 (as shown in FIGS. 6 and 10) formed on an outer wall of the axle sleeve 30 for blocking the frame element 50, so that the frame element 50 is limited by the trapezoidal surface 33 to restrict the movement of the axle sleeve 30 in the containing slot 11.

The second end surface 13 includes a plurality of plastic bumps 16 formed at the periphery of the base 10 and corresponding to the contour of the periphery of the frame element 50, and the frame element 50 is contained and positioned between the bumps 16, and the bumps 16 can be hot riveted for clamping and fixing the frame element 50 to prevent the frame element 50 and the base 10 from shaking, floating or being loosened.

Two symmetrical plastic ear plates 14 are formed on the base 10 adjacent to the side of the first end surface 12 and corresponding to the contour of the periphery of the positive and negative power supply pins 61, 62, and the positive and negative power supply pins 61, 62 are contained and positioned between the ear plates 14, and the ear plate 14 can be hot riveted to clamp and fix the positive and negative power supply pins 61, 62 to prevent the light emitting diode 60 from being floated or falling out.

The present invention further comprises a transparent press button 80 (as shown in FIG. 10) made of a soft heat resisting material, installed at a position on the axle sleeve 30 and exposed from the containing slot 11, and covering the cylindrical groove 31 and light emitting diode 60. Two hooks 34 are formed at positions adjacent to the notch 311 of the axle sleeve 30 for latching the press button 80, wherein the soft heat resisting material can be silicon. The press button 80 made of silicon can stand high heat, so that the press button 80 can enter into a solder furnace together with the axle sleeve 30 and the base 10. The installation of the press button 80 no longer requires the conventional way of processing the base of the switch in the solder furnace first, and then the press button is installed onto the axle sleeve.

When the light emitting diode 60 in the cylindrical groove 31 emits light, the light can pass through the transparent press button 80 to the outside to achieve the indicating and illuminating effects. In the meantime, the press button 80 is soft and elastic and capable of providing a buffer effect for sudden impacts to improve the service life of the switch.

In addition, a high temperature patch 100 with a flat surface is attached onto the top of the switch and capable of covering a gap junction between the retaining base 70 and the base 10 to facilitate the suction access during the SMT process to prevent a material drop situation.

What is claimed is:

1. A socket structure of a micro switch, having a plurality of conductive pins at the bottom of the switch, and the socket structure comprising:

a plurality of grooves, formed at the bottom of the switch, and the pins being disposed in the grooves respectively; and a plurality of distal slots, formed on an outer wall of the switch and interconnected to the grooves respectively, so that the pins are exposed from the outer wall of the switch;

wherein the pins include at least two electrode pins, and two power supply pins having at least one light emitting diode; and the switch comprises:

a retaining base, having at least one positioning pillar disposed at the bottom of the retaining base;

a base, disposed at a distal side of the retaining base, and having a containing slot formed on a side of the base, and a notch formed at an outer edge of the containing slot and having a height different from those of two first end surfaces and a second end surface, and the distance from a groove bottom of the containing slot to the first end surface being greater than the distance from the groove bottom to the second end surface;

the bottom of the switch bottom being the bottom of the retaining base and the base, and the outer wall of the switch being a wall exposed from the retaining base and the base;

an electrode set, installed in the containing slot, and having electrode pins extended to the bottom of the base;

an axle sleeve slidably installed in the containing slot and guided by an inner wall of the containing slot to selectively approach and separate the electrode set, the axle sleeve having a pair of cylindrical grooves formed thereon and opened to the outside;

a conductive bracket, installed in the containing slot between the axle sleeve and the electrode set, and driven by the axle sleeve to attach and separate the electrode set for connecting and disconnecting the electrode set respectively;

a metal frame element, sheathed on an external periphery of the axle sleeve and blocked and positioned by the second end surface, and the frame element having at least one positioning pin extended to the bottom of the base and situated adjacent to the distal slot; and a light emitting diode, installed in the cylindrical groove, and having a power supply pin extended to the bottom of the base, and blocked and positioned by the first end surface to define a specific distance between the frame element and the power supply pin.

2. The socket structure of a micro switch as recited in claim 1, wherein the retaining base has a plurality of mouldings formed on a distal side of the retaining base, and the base is disposed between the mouldings.

3. The socket structure of a micro switch as recited in claim 1, wherein the first end surfaces are formed on the base and protruded from both sides of a notch of the containing slot respectively.

4. The socket structure of a micro switch as recited in claim 1, wherein the axle sleeve includes guide slots formed on both upper and lower sides of the axle sleeve respectively and interconnected to the cylindrical groove, and the power supply pins are extended from the guide slots to the bottom of the switch.

5. The socket structure of a micro switch as recited in claim 1, wherein the frame element has an opening sheathed on the external periphery of the axle sleeve.

6. The socket structure of a micro switch as recited in claim 1, wherein the frame element includes an ear plate formed on both sides of the frame element separately, and the retaining base has a latch portion formed on both sides of the retaining base separately, and the ear plate has a latch slot latched onto the latch portion.

7. The socket structure of a micro switch as recited in claim 1, wherein the second end surface has a plurality of bumps formed around the periphery of the base and at positions corresponding to the contour of the periphery of the frame element, and the frame element is contained and positioned between the bumps.

8. The socket structure of a micro switch as recited in claim 1, wherein the first end surface has two ear plates formed on a side of the base and at positions corresponding to the contour of the periphery of the power supply pin, and the power supply pin is contained and positioned between the ear plates.

9. The socket structure of a micro switch as recited in claim 1, further comprising a transparent press button made by using a soft heat-resisting material, installed at a position on the axle sleeve, exposed from the containing slot, and covering the cylindrical groove.

10. The socket structure of a micro switch as recited in claim 9, wherein the soft heat-resisting material is silicone.

11. The socket structure of a micro switch as recited in claim 1, further comprising a high temperature patch with a flat surface attached onto the top of the switch.

12. A socket structure of a micro switch, having a plurality of conductive pins at the bottom of the switch, and the socket structure comprising:

a plurality of grooves, formed at the bottom of the switch, and the pin being installed in the groove; and a plurality of distal slots, formed on the outer wall of the switch, and the top of the pins being extended into the distal slots respectively and exposed from the outer wall of the switch;

wherein, the pins include at least two electrode pins, and two power supply pins having at least one light emitting diode; and the switch comprises:

a retaining base, having at least one positioning pillar disposed at the bottom of the retaining base;

a base, disposed at a distal side of the retaining base, and having a containing slot formed on a side of the base, and a notch formed at an outer edge of the containing slot and having a height different from those of two first end surfaces and a second end surface, and the distance from a groove bottom of the containing slot to the first end surface being greater than the distance from the groove bottom to the second end surface;

the bottom of the switch bottom being the bottom of the retaining base and the base, and the outer wall of the switch being a wall exposed from the retaining base and the base;

an electrode set, installed in the containing slot, and having electrode pins extended to the bottom of the base; an axle sleeve, slidably installed in the containing slot, and guided by an inner wall of the containing slot to selectively approach and separate the electrode set, and the axle sleeve having a pair of cylindrical grooves formed thereon and opened to the outside;

a conductive bracket, installed in the containing slot between the axle sleeve and the electrode set, and driven by the axle sleeve to attach and separate the electrode set for connecting and disconnecting the electrode set respectively;

a metal frame element, sheathed on an external periphery of the axle sleeve and blocked and positioned by the second end surface, and the frame element having at least one positioning pin extended to the bottom of the base and situated adjacent to the distal slot; and a light emitting diode, installed in the cylindrical groove, and having a power supply pin extended to the bottom of the base, and blocked and positioned by the first end surface to define a specific distance between the frame element and the power supply pin.

13. The socket structure of a micro switch as recited in claim 12, wherein the retaining base has a plurality of mouldings formed on a side of the retaining base, and the base is disposed between the mouldings.

14. The socket structure of a micro switch as recited in claim 12, wherein the first end surfaces are formed on the base and protruded from both sides of a notch of the containing slot respectively.

15. The socket structure of a micro switch as recited in claim 12, wherein the axle sleeve includes guide slots formed on both upper and lower sides of the axle sleeve respectively and interconnected to the cylindrical groove, and the power supply pins are extended from the guide slots to the bottom of the switch.

16. The socket structure of a micro switch as recited in claim 12, wherein the frame element has an opening sheathed on the external periphery of the axle sleeve.

17. The socket structure of a micro switch as recited in claim 12, wherein the frame element includes an ear plate formed on both sides of the frame element separately, and the retaining base has a latch portion formed on both sides of the retaining base separately, and the ear plate has a latch slot latched onto the latch portion.

18. The socket structure of a micro switch as recited in claim 12, wherein the second end surface has a plurality of bumps formed at position on the base and corresponding to the contour of the periphery of the frame element, and the frame element is contained and positioned between the bumps.

19. The socket structure of a micro switch as recited in claim 12, wherein the first end surface has two ear plates formed on a side of the base and at positions corresponding to the contour of the periphery of the power supply pin, and the power supply pin is contained and positioned between the ear plates.

20. The socket structure of a micro switch as recited in claim 12, further comprising a transparent press button made of a soft heat resisting material, installed at a position on the axle sleeve, exposed from the containing slot, and covering the cylindrical groove.

21. The socket structure of a micro switch as recited in claim 20, wherein the soft heat resisting material is silicon.

22. The socket structure of a micro switch as recited in claim 12, further comprising a high temperature patch with a flat surface attached onto the top of the switch.

* * * * *